US005079798A

United States Patent [19]

Burke et al.

[11] Patent Number: 5,079,798

[45] Date of Patent: Jan. 14, 1992

[54] GLASS HINGE ASSEMBLY

[76] Inventors: Anthony Burke, 16465 Green Tree Blvd., #60, Victorville, Calif. 92392; Richard Dawson, 1275 Swansea Ave., Ventura, Calif. 93004

[21] Appl. No.: 565,839

[22] Filed: Aug. 13, 1990

[51] Int. Cl.[5] ..... E05D 5/02; E05D 7/08; E05F 1/14

[52] U.S. Cl. ..... 16/252; 16/281; 16/379

[58] Field of Search ..... 16/252, 378, 379, 390, 16/281

[56] References Cited

FOREIGN PATENT DOCUMENTS 2432158 1/1976 Fed. Rep. of Germany .
2739939 3/1979 Fed. Rep. of Germany .
2748623 5/1979 Fed. Rep. of Germany .

*Primary Examiner*—Robert L. Spruill
*Assistant Examiner*—Carmine Cuda
*Attorney, Agent, or Firm*—John J. Posta, Jr.

[57] ABSTRACT

The improved glass hinge assembly includes a first hinge component in the form of a glass clamp having a spaced pair of flat, parallel vertical walls interconnected by a connector block therebetween, the walls and connector block defining a peripheral glass-receiving space. The block is notched out in the rear so as to receive a pivot block connected to and projecting forwardly from the front end of a second hinge component of the assembly, which second component can be a glass clamp similar to the first glass clamp or a flat wall bracket disposed perpendicular to the pivot block. A hinge sub-assembly interconnects the two hinge components through the connector block of the first hinge component and the pivot block. That sub-assembly preferably includes a vertical cylindrical pin with a flattened area perpendicular to the main plane of the first hinge component, and a biasing spring and plastic bushing in the pivot block bearing against the flattened area to bias the first hinge component into a closed position parallel to the pivot block. The assembly is adapted to hold a pane of a glass door for hinged pivoting and for pivotably hinging together two adjacent panes of glass, as in a folding glass door.

8 Claims, 2 Drawing Sheets

GLASS HINGE ASSEMBLY

BACKGROUND OF THE INVENTION

1. Field of the Invention

The present invention generally relates to hinge means and more particularly to hinges of an improved type specifically adapted for use with glass panes for glass doors and the like.

2. Prior Art

The usual types of hinges for doors, including glass doors, comprise a pair of flat unitary plates connected end to end by external hinges. Such hinges lack an attractive appearance and require the time-consuming drilling of transverse closely spaced holes in glass panes, with resulting danger of cracking or breaking the glass panes. Moreover, as the hinged glass pane is used, stress is placed on it and glass breakage at the hinge can easily occur.

There remains a need for an improved type of glass hinge for glass doors, including the multi-pane folding type. Such hinge should eliminate the danger of cracking of the glass at the hinge, should distribute glass stress in the door for longer wear and should be easy, rapid and inexpensive to install and use. It should also have an improved appearance, preferably without ugly external hinge pins and the like. It should be capable of being fabricated in a variety of sizes and shapes and types for different applications.

SUMMARY OF THE INVENTION

The improved glass hinge assembly of the present invention satisfies all the foregoing needs. The assembly is substantially as set forth in the Abstract of the Disclosure. The assembly is attractive, inexpensive, durable and efficient. It has an internal spring-biased hinge system and connects to one or more glass panes not by screws or bolts, but by seating and anchoring the pane or panes in a deep peripheral groove in a single glass clamp component or in both of the two glass clamp components. The glass is securely held therein as by permanent bonding adhesive or the like, so that stress on the glass is distributed uniformly over a wide area and in multiple directions, thus avoiding glass cracking during installation and use of the hinge assembly. The result is a highly efficient assembly of highly attractive appearance and great durability.

In one embodiment, the assembly includes a pair of aligned glass clamps hingedly joining together a pair of glass panes, such as are used in glass folding doors, screens and the like. In another embodiment, the assembly includes a single glass clamp interconnected through a hinge and pivot block with a wall bracket. Preferably, the glass clamp or clamps are spring biased into an in-line closed position, but are easily movable to open positions.

The assembly is preferably made of brass or steel in a generally flat vertically extending eye-appealing form and in any desired size. Hinges are concealed. Further features of the present invention are set forth in the following detailed description and accompanying drawings.

DRAWINGS

DETAILED DESCRIPTION

FIGS. 1–8

Figure 1:
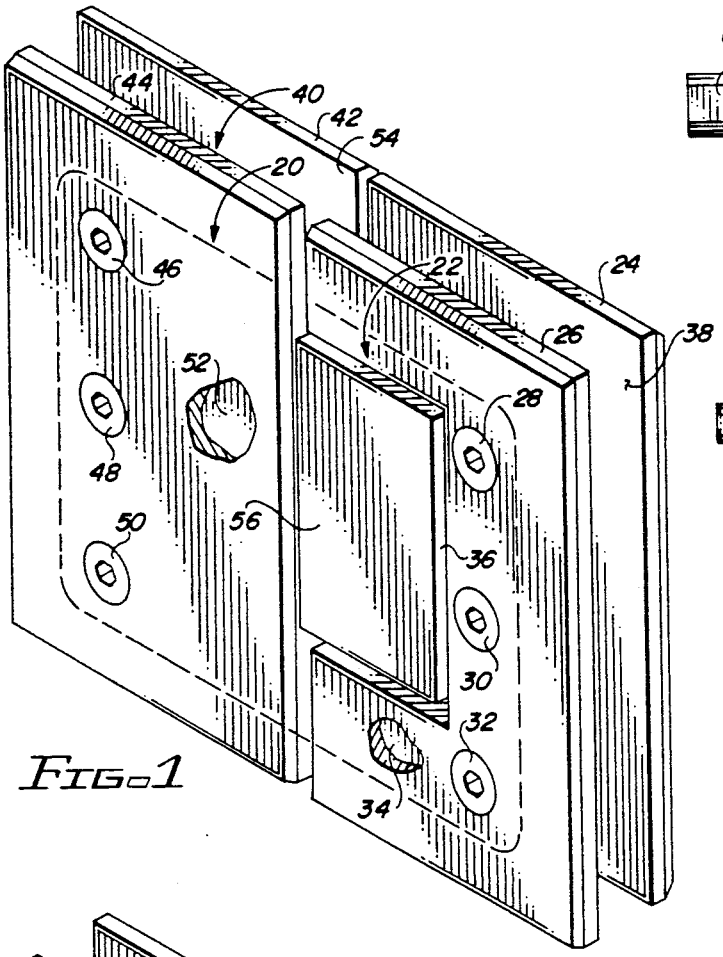
FIG. 1 is a schematic perspective side elevation, partly broken away, of a first preferred embodiment of the improved glass hinge assembly of the present invention.
Figure 3:
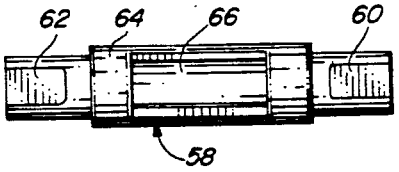
FIG. 3 is a schematic rear elevation of the hinge pin used in the embodiment of FIG. 2.
Figure 4:
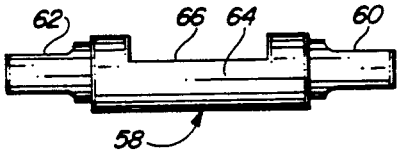
FIG. 4 is a schematic side elevation of the pin of FIG. 3.
Figure 5:
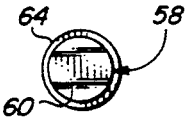
FIG. 5 is a schematic top plan view of the pin of FIG. 3.
Figure 6:
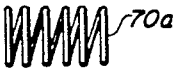
FIG. 6 is a schematic side elevation of the spring used in the embodiment of FIG. 2.
Figure 7:
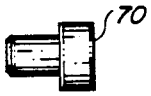
FIG. 7 is a schematic side elevation of the spring bushing used in the embodiment of FIG. 2.
Figure 8:
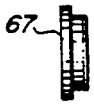
FIG. 8 is a schematic side elevation of the circular pin bushing used in the embodiment of FIG. 2.

Now referring more particularly to FIGS. 1–8 of the drawings, a first preferred embodiment of the improved glass hinge assembly of the present invention is schematically depicted therein. Thus, as shown particularly in FIGS. 1 and 2, assembly 20 is provided which comprises a first hinge component 22 preferably of metal such as steel or brass, which is in the form of a glass clamp which comprises a spaced vertically extending pair of parallel rectangular walls 24 and 26 interconnected, as by transverse screws 28, 30 and 32, to a narrow rectangular connector block 34 disposed therebetween. Walls 24 and 26 and connector block 34 are flat and vertical and generally rearwardly facing U-shaped, open rearwardly extending space 36.

Figure 2:
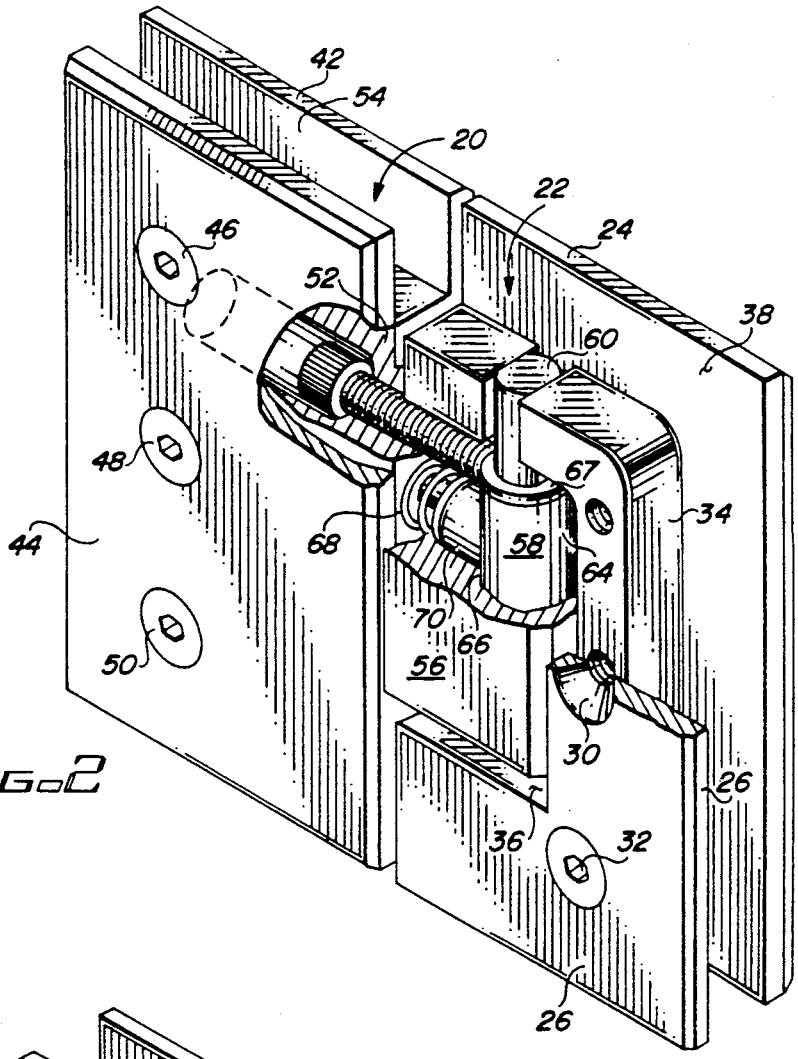
FIG. 2 is a schematic perspective side elevation, further partly broken away, of the glass hinge assembly of FIG. 1.

Block 34 is smaller in diameter than walls 24 and 26 so that when block 34 is connected thereto as shown in FIG. 2, there is provided between walls 24 and 26 a deep peripheral slot or glass pane-receiving space 38. Thus, a glass pane (not shown) can be permanently cemented in space 38 after being notched out to receive block 34, so as to permanently attach such pane and component 22 together without initial or subsequent glass chipping, cracking or strain.

Assembly 20 also includes a second hinge component 40 substantially identical to first hinge component 22, except as hereafter noted. Thus, component 40 includes a second glass clamp in the form of a spaced vertically extending pair of parallel rectangular walls 42 and 44 interconnected, as by transverse screws 46, 48 and 50, to a narrow rectangular connector block 52 disposed therebetween. Walls 42 and 44 and connector block 52 are generally flat and vertical.

Block 52 is smaller in diameter than walls 42 and so as to provide therewith a block [-shaped peripheral slot or space 54 for the reception of a second glass pane (not shown), when suitably notched out to receive block 52. Such pane can be anchored therein, as by permanent cement, etc. to prevent initial or subsequent cracking or breaking of the two panes.

Component 22 is connected to component 40 by providing component 40 with a rectangular pivot block 56 which is connected to the front end of block 52 and which projects forwardly thereof into rear space 36 of component 22. Block 56 is hinged to block 34 by a vertical generally cylindrical hinge pin 58 (FIGS. 2-5) extending therethrough, which pin 58 has a narrowed top 60 and bottom 62 and a generally cylindrical central portion 64 with a rearwardly extending flattened face 66. Cylindrical ring bushings 67 can be provided around pin 58 as shown in FIG. 2 to prevent wear.

A spring 68 covered with a cylindrical front bushing 70 is urged into contact with face 66 by a screw 72 which passes forwardly through blocks 52 and 56. A second like set comprising a spring, front bushing and urging screw (not shown) is disposed below the described first set in blocks 52 and 56 and contacts face 66.

The two sets cause components 24 and 40 to have the resting, aligned glass pane, single pane closed position shown in FIGS. 1 and 2, but can be pivoted against the spring bias to and returned from an open position where components 22 and 40 are at a 90° angle from each other.

When a plurality of assemblies 20 are spaced along the vertical length of an adjoining pair of glass panes in a folding glass door construction or the like, securely hold the panes without straining them. Moreover, no unsightly hinges are seen, since they are concealed by the glass panes and are within assembly 20, not protruding from it. Accordingly, assembly 20 is of an improved design.

FIG. 9

Figure 9:
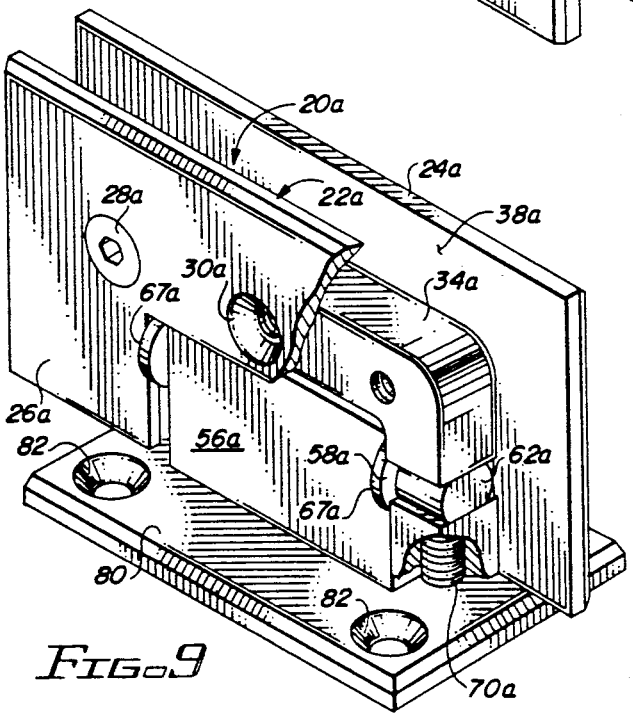
FIG. 9 is a schematic side perspective view, partly broken away, of a second preferred embodiment of the improved glass hinge assembly of the present invention; and, FIG. 10 is a schematic side perspective view, partly broken away, of a preferred embodiment of a glass wall bracket assembly usable with the glass hinge assembly of the present invention.

A second preferred embodiment of the improved glass hinge assembly of the present invention is schematically depicted in FIG. 9. Components thereof similar to those of FIGS. 1-8 bear the same numerals but are succeeded by the letter "a".

Thus, assembly 20*a* is shown in a tilted over position, resting on the rear thereof. Assembly 20*a* differs from assembly 20 only as follows:

a) assembly 20*a* is adapted to pivotably connect a pane of glass to a wall, rather than pivotably interconnecting two panes of glass, as in assembly 20;

b) component 40*a* has no parallel walls and connector block, but instead has a transversely extending flat wall bracket 80 with screw holes 82 therein for attachment of bracket 80 to a wall; bracket 80 is directly connected to forwardly extending pivot block 56*a* received in rear space 36*a* and pivoted to component 22*a* by pin 58*a*.

Assembly 20*a* has substantially the advantages of assembly 20.

FIG. 10

Figure 10:
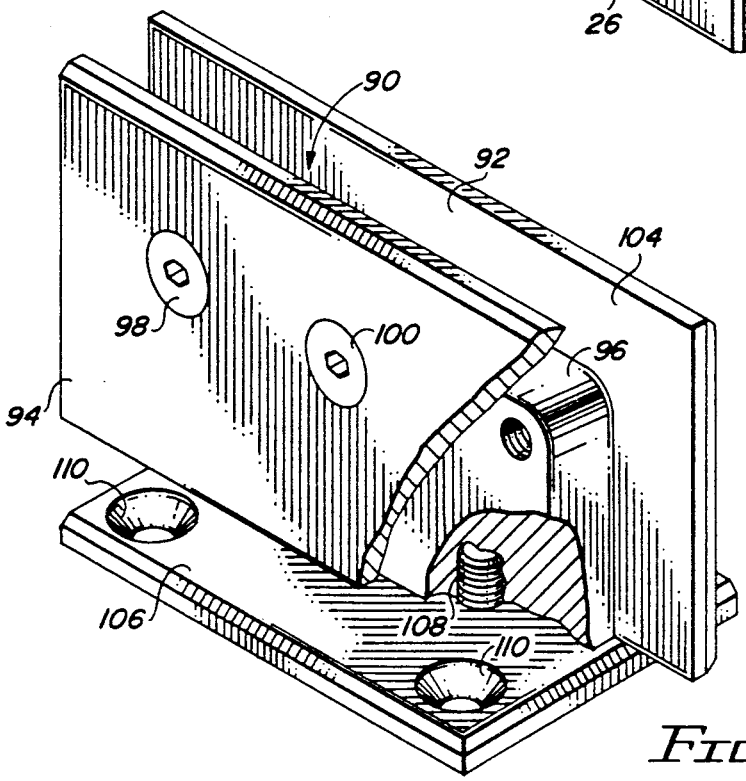

A glass pane wall bracket usable with assembly 20 and assembly 20*a* is schematically depicted in FIG. 10. Thus, bracket assembly 90 is shown which comprises a spaced pair of parallel, vertically extending, flat, rectangular walls 92 and 94 interconnected to a connector block 96 disposed therebetween, by transverse screws 98 and 100 and the like. Block 96 is of smaller diameter than walls 92 and 94 so as to form peripheral, glass pane-receiving space 104 with walls 92 and 94.

A transverse wall bracket plate 106 is secured to the rear end of block 96, as by screws 108 and bears spaced screw holes 110 for attachment of assembly 90 to the wall of a shower stall in a bathroom or the like, or for another use.

Various other modifications, changes, alterations and additions can be made in the improved glass hinge assembly of the present invention, its components and parameters. All such modifications, changes, alterations and additions as are within the scope of the appended claims form part of the present invention. What is claimed is the following.

What is claimed is:

1. An improved glass hinge assembly, said assembly comprising, in combination:

a) a first hinge component comprising a glass clamp having a pair of spaced parallel walls interconnected by a connector block therebetween, said walls and connector block collectively defining a peripheral glass-receiving space, said block being notched out at the rear end thereof to provide a space for receiving a pivot block;

b) a second hinge component comprising a support member bearing a pivot block projecting from the front end thereof into said notched out space;

c) hinge means secured through said two blocks, thereby hingedly interconnecting said two hinge components; and d) wherein said second hinge component includes a second glass clamp having a second pair of spaced parallel walls interconnected by a second connector block, said second pair of walls and second connector block collectively defining a second peripheral glass-receiving space.

2. The improved glass hinge assembly of claim 1 wherein said second glass clamp in the closed position is in the same main plane as said first glass clamp and wherein both said clamps and said pivot block are generally flat and vertically extending.

3. The improved glass hinge assembly of claim 2 wherein said hinge means comprises a vertical cylindrical pin through said pivot block and said first connector block, wherein said pin has a flattened area perpendicular to the main plane of said clamps, and wherein a spring in said pivot block bears against such flattened area and biases said clamps into said closed position.

4. An improved glass hinge assembly, said assembly comprising, in combination:

a) a first hinge component comprising a glass clamp having a pair of spaced parallel walls interconnected by a connector block therebetween, said walls and connector block collectively defining a peripheral glass-receiving space, said block being notched out at the rear end thereof to provide a space for receiving a pivot block;

b) a second hinge component comprising a support member bearing a pivot block projecting from the front end thereof into said notched out space;

c) hinge means secured through said two blocks, thereby hingedly interconnecting said two hinge components;

d) wherein said hinge means comprises a pin extending through both said blocks;

e) wherein said pin is generally cylindrical but has a flattened central area, and f) wherein spring means in said pivot block bear against said flattened area to bias said two hinge components into a closed position.

5. The improved glass hinge assembly of claim 4 wherein a plastic bushing is disposed between said spring and flattened area, wherein said flattened area is perpendicular to the main plane of said pivot block and first hinge component.

6. The improved glass hinge assembly of claim 5 wherein said pin is vertical and wherein said first hinge component and blocks are generally flat and vertically extending.

7. The improved glass hinge assembly of claim 4 wherein said second hinge component includes a rear wall bracket disposed generally perpendicular to said glass clamp.

8. The improved glass hinge assembly of claim 7 wherein said clamp is vertically oriented and generally flat and wherein said glass hinge means comprises a vertical cylindrical pin through said two blocks, said pin having a flattened area perpendicular to the vertical plane of said clamp and pivot block, and wherein a spring in said pivot block bears against said flattened area and biases said clamp into a closed position.

* * * * *